US009532126B1

(12) United States Patent
Kelly et al.

(10) Patent No.: US 9,532,126 B1
(45) **Date of Patent: *Dec. 27, 2016**

(54) AUDIO EARBUD HEADPHONE FOR IMPROVED IN-EAR RETENTION

(75) Inventors: Peter M. Kelly, Park City, UT (US); Richard P. Alden, Park City, UT (US)

(73) Assignee: Skullcandy, Inc., Park City, UT (US)

( * ) Notice: Subject to any disclaimer, the term of this patent is extended or adjusted under 35 U.S.C. 154(b) by 552 days.

This patent is subject to a terminal disclaimer.

(21) Appl. No.: 13/326,099

(22) Filed: Dec. 14, 2011

Related U.S. Application Data

(63) Continuation-in-part of application No. 12/860,648, filed on Aug. 20, 2010, now Pat. No. 8,515,115, which is a continuation-in-part of application No. 29/353,313, filed on Jan. 6, 2010, now Pat. No. Des. 624,057.

(51) Int. Cl.
*H04R 1/10* (2006.01)

(52) U.S. Cl.
CPC ..... *H04R 1/1008* (2013.01); *H04R 1/1016* (2013.01)

(58) Field of Classification Search
CPC ..... H04R 1/1016; H04R 1/105
USPC ..... 381/74, 71.5–71.6, 370–380
See application file for complete search history.

(56) References Cited

U.S. PATENT DOCUMENTS

| | | | |
|---|---|---|---|
| D237,090 | S | 10/1975 | Yanagawa |
| 4,736,435 | A | 4/1988 | Yokoyama et al. |
| 4,965,838 | A | 10/1990 | Kamon et al. |
| D331,061 | S | 11/1992 | Hyohgo |
| 5,222,151 | A | 6/1993 | Nagayoshi et al. |
| D337,589 | S | 7/1993 | Wada |
| D340,932 | S | 11/1993 | Yan |
| 5,420,935 | A | 5/1995 | Shinohara et al. |
| 5,809,159 | A | 9/1998 | Lee |
| 5,809,933 | A | 9/1998 | Conwell |
| 5,949,896 | A | 9/1999 | Nageno et al. |
| 6,122,369 | A | 9/2000 | Hwang et al. |
| D449,295 | S | 10/2001 | Smith |
| D470,122 | S | 2/2003 | Hlas et al. |
| D471,537 | S | 3/2003 | Ham |
| 6,704,429 | B2 | 3/2004 | Lin |

(Continued)

FOREIGN PATENT DOCUMENTS

| | | | |
|---|---|---|---|
| CA | 2515558 | A1 | 2/2007 |
| CA | 2697029 | A1 | 2/2007 |

(Continued)

OTHER PUBLICATIONS

Yurbuds Sport Headphones [online], URL: http://www.yurbuds.com, 6 pages.

*Primary Examiner* — George Monikang
(74) *Attorney, Agent, or Firm* — TraskBritt

(57) ABSTRACT

Earbud headphones configured for use with a portable media player that include a main body portion with an extended curvature configuration. In one example implementation, the earbud headphones include a speaker housing and an extension that form a gap between the speaker housing and the extension. A user can secure a portion of the user's outer ear in the gap (i.e., between the extension and speaker housing), such that the earbud is securely and comfortably held in place within the user's ear. Additionally, the earbud headphones can include interchangeable components, such that a user can customize the size, fit, and style of the earbud headphones.

20 Claims, 8 Drawing Sheets

(56) References Cited

U.S. PATENT DOCUMENTS

| | | | | |
|---|---|---|---|---|
| 6,728,387 | B1 * | 4/2004 | Polito | H04R 1/105 381/375 |
| 6,738,487 | B1 | 5/2004 | Nageno et al. | |
| D504,883 | S | 5/2005 | Jacobson et al. | |
| D517,043 | S | 3/2006 | Jacobson et al. | |
| D523,846 | S | 6/2006 | Lee | |
| D533,868 | S | 12/2006 | Koizumi | |
| 7,187,948 | B2 | 3/2007 | Alden | |
| D554,109 | S | 10/2007 | Ledbetter et al. | |
| D556,741 | S | 12/2007 | Yeo | |
| D557,689 | S | 12/2007 | Huang | |
| D568,291 | S | 5/2008 | Andre et al. | |
| D572,242 | S | 7/2008 | Yang | |
| D572,703 | S | 7/2008 | Ledbetter et al. | |
| D572,706 | S | 7/2008 | Schaefer | |
| D573,977 | S | 7/2008 | Ledbetter et al. | |
| 7,395,090 | B2 | 7/2008 | Alden | |
| D575,269 | S | 8/2008 | Ledbetter et al. | |
| D585,053 | S | 1/2009 | Zeiss | |
| D589,933 | S | 4/2009 | Zeiss | |
| D591,722 | S | 5/2009 | Densho | |
| D593,537 | S | 6/2009 | Arimoto | |
| D618,218 | S | 6/2010 | Burgett et al. | |
| D618,219 | S | 6/2010 | Burgett et al. | |
| D623,627 | S | 9/2010 | Alden et al. | |
| D624,057 | S | 9/2010 | Kelly et al. | |
| D627,765 | S | 11/2010 | Zheng | |
| D631,034 | S | 1/2011 | Yeo | |
| D632,282 | S | 2/2011 | Kitayama | |
| D639,279 | S | 6/2011 | Andre et al. | |
| D641,003 | S | 7/2011 | Alden | |
| 8,014,824 | B2 | 9/2011 | Alden | |
| 8,032,191 | B2 | 10/2011 | Yang | |
| D650,356 | S | 12/2011 | Alden et al. | |
| 8,083,022 | B2 | 12/2011 | Gommel et al. | |
| 8,111,861 | B2 | 2/2012 | Lowry | |
| D656,129 | S | 3/2012 | Kelly et al. | |
| 8,180,090 | B2 | 5/2012 | Hupkes | |
| D665,776 | S | 8/2012 | Alden et al. | |
| D665,777 | S | 8/2012 | Alden et al. | |
| D673,136 | S | 12/2012 | Kelly et al. | |
| D673,140 | S | 12/2012 | Kelly et al. | |
| D674,372 | S | 1/2013 | Kelly et al. | |
| D674,376 | S | 1/2013 | Kelly et al. | |
| D676,023 | S | 2/2013 | Kelly et al. | |
| D676,024 | S | 2/2013 | Kelly et al. | |
| D677,241 | S | 3/2013 | Kelly et al. | |
| D683,717 | S | 6/2013 | Kelly et al. | |
| D685,729 | S | 7/2013 | Kelly et al. | |
| D685,767 | S | 7/2013 | Kelly et al. | |
| D689,464 | S | 9/2013 | Bonahoom et al. | |
| D691,582 | S | 10/2013 | Nguyen et al. | |
| D693,793 | S | 11/2013 | Kelly et al. | |
| D699,216 | S | 2/2014 | Bonahoom et al. | |
| 2002/0090104 | A1 | 7/2002 | Ma | |
| 2005/0247515 | A1 | 11/2005 | Berg | |
| 2007/0081688 | A1 | 4/2007 | Chen | |
| 2007/0142025 | A1 | 6/2007 | Alden | |
| 2007/0189570 | A1 | 8/2007 | Matsuo et al. | |
| 2008/0107299 | A1 | 5/2008 | Lin | |
| 2008/0187159 | A1 * | 8/2008 | Blanchard | A61F 11/08 381/328 |
| 2008/0267440 | A1 | 10/2008 | Alden | |
| 2008/0310666 | A1 | 12/2008 | Wengreen | |
| 2009/0028356 | A1 * | 1/2009 | Ambrose | H04R 1/1091 381/71.6 |
| 2009/0041281 | A1 | 2/2009 | Chang | |
| 2011/0164776 | A1 | 7/2011 | Kelly et al. | |
| 2011/0235819 | A1 | 9/2011 | Alden | |
| 2012/0128172 | A1 | 5/2012 | Alden | |
| 2012/0275615 | A1 | 11/2012 | Kelly et al. | |
| 2013/0118944 | A1 | 5/2013 | Niiro et al. | |
| 2013/0130540 | A1 | 5/2013 | Oman et al. | |
| 2013/0177165 | A1 | 7/2013 | Oishi | |
| 2013/0177195 | A1 | 7/2013 | Sze et al. | |
| 2013/0185905 | A1 | 7/2013 | Stiff et al. | |
| 2013/0208909 | A1 | 8/2013 | Mülder et al. | |
| 2013/0336514 | A1 | 12/2013 | Kelly et al. | |

FOREIGN PATENT DOCUMENTS

| | | |
|---|---|---|
| EP | 0611111 A1 | 8/1994 |
| EP | 0825796 A2 | 2/1998 |
| EP | 1058479 | 6/2000 |
| EP | 1760896 | 9/2010 |
| EP | 2262117 | 12/2010 |
| WO | 2010068495 | 6/2010 |
| WO | 2010124190 | 10/2010 |
| WO | 2011085096 | 7/2011 |
| WO | 2012024656 | 2/2012 |

* cited by examiner

AUDIO EARBUD HEADPHONE FOR IMPROVED IN-EAR RETENTION

CROSS-REFERENCE TO RELATED APPLICATIONS

This application is a continuation-in-part of U.S. patent application Ser. No. 12/860,648, filed Aug. 20, 2010, now U.S. Pat. No. 8,515,115, issued Aug. 20, 2013, and entitled "Audio Earbud Headphone With Extended Curvature," which is a continuation-in-part of U.S. Design patent application Ser. No. 29/353,313, filed on Jan. 6, 2010, now U.S. Design Pat. No. D624,057, the disclosure of each of which is incorporated herein in its entirety by this reference.

TECHNICAL FIELD

The present disclosure is generally related to audio headphones.

BACKGROUND

Conventional portable audio systems often include a pair of headphones that are connected to a portable media player (e.g., with one or more wires). As the headphone industry has expanded, the style range of headphones from which a user may choose has increased. One popular style or configuration of headphones is known as "earbud"-style headphones (e.g., headphones designed to fit within a user's ear). Earbud-style headphones are popular among users because earbud headphones are generally small and portable. Moreover, when a user is participating in various activities, earbud headphones may cooperate better with the user's other accessories or equipment, such as helmets, ski goggles, ear protectors, beanies, and headbands.

Although a user may gain portability with conventional earbud-style headphones, a user may sacrifice comfort because conventional earbud-style headphones typically do not fit comfortably in every user's ear the same. Manufacturers/designers of conventional earbuds typically design earbud headphones to be held in place within a user's ear by sizing the earbud to be slightly larger than the outer ear of the user. As can be appreciated, users generally have wide ranges of outer ear sizes and configurations, which makes it difficult for one size of earbud to comfortably fit all users' ears.

For example, in many circumstances, a user's outer ear may be too small for the conventional earbud-style headphone to comfortably fit in the user's outer ear. If the earbud is too large, then the earbud may fall out of the user's ear during use, or the earbud may cause discomfort to the user, thus frustrating the user and preventing the user from enjoying the portable audio system. On the other hand, the earbud-style headphone may be too small, thus preventing the earbud from remaining in place adjacent to the user's ear canal. If the earbud is too small, then the sound quality may decrease and the earbud may tend to frequently fall out of the user's ear.

BRIEF SUMMARY OF THE INVENTION

Implementations of the present invention comprise devices, systems, and methods, for earbud-style headphones with an extended curvature configuration. For example, implementations of the invention provide an earbud headphone that includes a speaker housing and an extension that forms a gap between the speaker housing and the extension.

In one implementation, the extension allows a user to secure a portion of the user's outer ear in the gap (i.e., between the extension and speaker housing), such that the earbud headphone maintains a secure and comfortable position within the user's ear.

For example, an implementation of an earbud headphone includes a speaker assembly capable of converting an audio signal into a sound wave audible to the human ear. The earbud headphone further can include a main body portion that at least partially encloses the speaker assembly. In addition, an extension can extend out from the main body portion and away from the speaker assembly, such that a gap is formed between the speaker assembly and the extension. Thus, a user can position at least a portion of the user's ear in the gap between the extension and the speaker assembly to securely hold the earbud headphone within the user's ear.

In addition, a personal audio speaker system for use with a portable media playing device can include a wire that connects to the portable media playing device and a set of earbud headphones. The set of earbud headphones can be configured to securely fit within a user's ear, such that the earbud headphones remain within the user's ear during use. The earbud headphones can include a speaker assembly that is connected to the wire, and a speaker housing that is attached to a back portion of the speaker assembly. A main body portion can at least partially enclose the speaker assembly and speaker housing. Additionally, an extension can extend out from the main body portion and away from the speaker housing forming a gap between the extension and the speaker housing.

Furthermore, an implementation of an interchangeable earbud headphone kit can include an earbud headphone that has a main body portion. The main body portion includes a retainer portion and an extension that extends away from the retainer portion such that a gap is formed between the retainer portion and the extension. Moreover, the interchangeable earbud headphone kit can include a retainer ring that is removably connected to the retainer portion. Additionally, the interchangeable earbud headphone kit can include interchangeable components. In one example, the retainer ring is operatively associated with the retainer portion to secure the interchangeable components to the main body portion as desired by a user. Thus, a user can remove the retainer ring from the retainer portion to exchange components of the earbud headphones to customize the size, configuration, and aesthetics of the earbud headphones. For example, the user can exchange the speaker assembly, the speaker housing, and/or the main body portion.

Additional features and advantages of exemplary implementations of the invention will be set forth in the description that follows and, in part, will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof that are illustrated in the appended drawings. Understanding that these drawings depict only typical embodiments of the invention and are not, therefore, to be considered to be limiting of its scope, the invention will be described and explained with additional specificity and detail through the use of the accompanying drawings in which.

DETAILED DESCRIPTION OF THE PREFERRED EMBODIMENTS

Implementations of the present invention comprise devices, systems, and methods for earbud-style headphones with an extended curvature configuration. For example, implementations of the invention provide an earbud headphone that includes a speaker housing and an extension that forms a gap between the speaker housing and the extension. In one implementation, the extension allows a user to secure a portion of the user's outer ear in the gap (i.e., between the extension and speaker housing), such that the earbud headphone maintains a secure and comfortable position within the user's ear.

For example, implementations of the present invention provide an earbud headphone that is securely held in place no matter the size or shape of the user's ear. For example, unlike many conventional earbud headphones, implementations of the present invention provide an earbud headphone that is secured within the user's ear by using various elements and features that directly engage the user's ear. Thus, implementations of the present invention provide an earbud headphone that is far less likely to fall out of the user's ear compared to conventional earbud-style headphones.

Moreover, implementations of the present invention thus provide an earbud headphone that is comfortable to wear no matter the size or configuration of a user's ear. For example, notwithstanding the size or shape of the user's ears, implementations of the present invention provide an earbud that is comfortable to wear. Therefore, unlike many conventional earbud headphones, the user's ear does not experience discomfort or pain while the user is wearing the earbud.

In addition, implementations of the present invention provide an earbud headphone with improved acoustic properties. In particular, due to the configuration of the earbud headphone disclosed herein, the earbud headphone acoustics are clearer and richer. For example, the bass tones can be deeper, the tenor tones can be crisper, and the mid-range tones can be clearer compared to earbud headphones that lack the same configuration.

Figure 1:
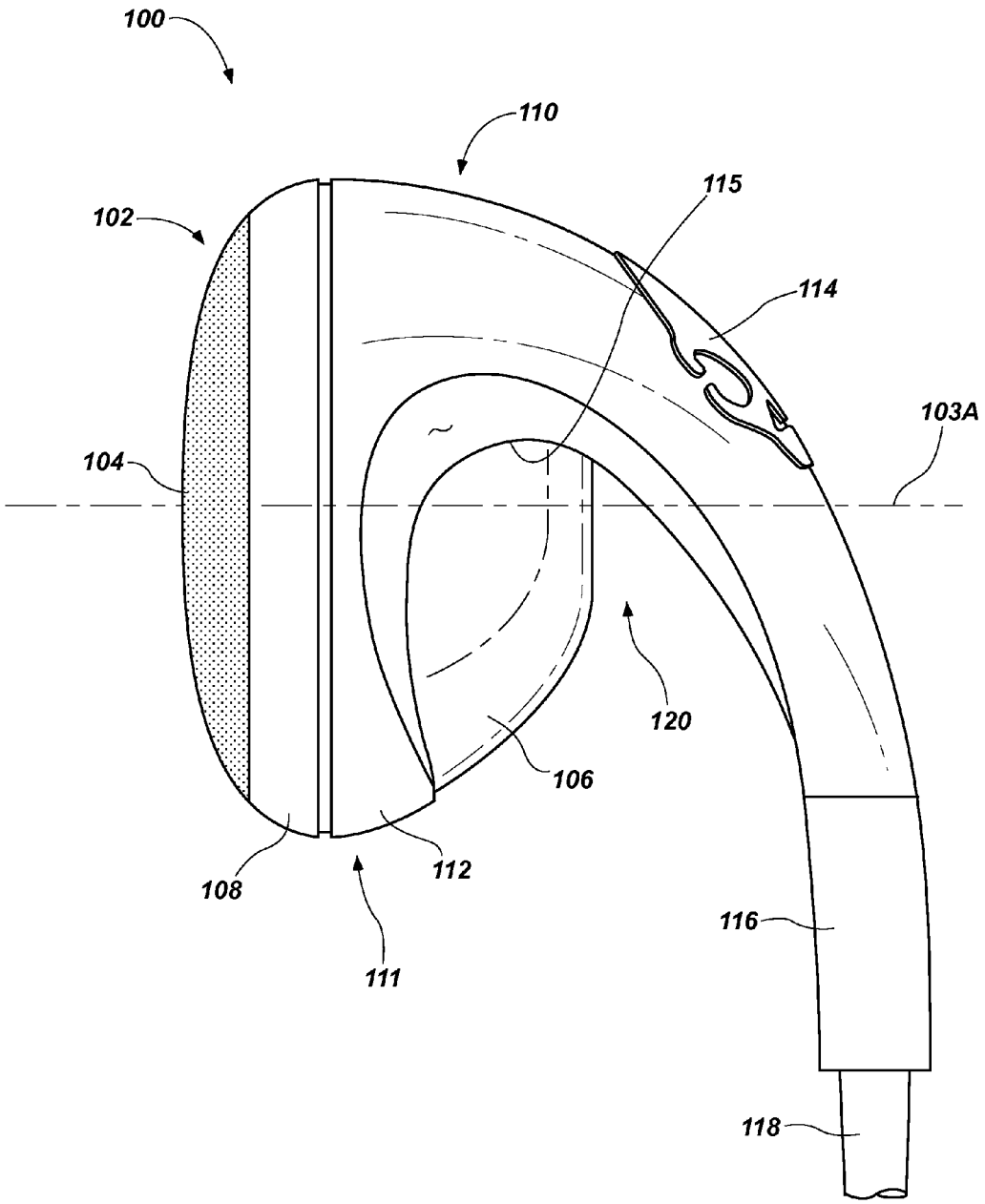
FIG. 1 illustrates a side view of an earbud headphone in accordance with an implementation of the present invention.

As mentioned, implementations of the present invention provide an earbud headphone that can include various features and characteristics. FIG. 1 illustrates one example implementation of an earbud headphone 100. FIG. 1 shows that the exemplary earbud headphone 100 can comprise various components, each having various characteristics and configurations. For example, FIG. 1 shows that the earbud headphone 100 can include a speaker assembly 102. The speaker assembly 102 comprises various internal speaker components that are configured to convert an audio signal into an audible sound wave that can be heard by human ears. Example internal speaker components can include coils, magnets, drivers, cones, electronics, and electrical connections that provide the speaker assembly 102 the capability of converting the audio signal into the audible sound wave.

Figure 3:
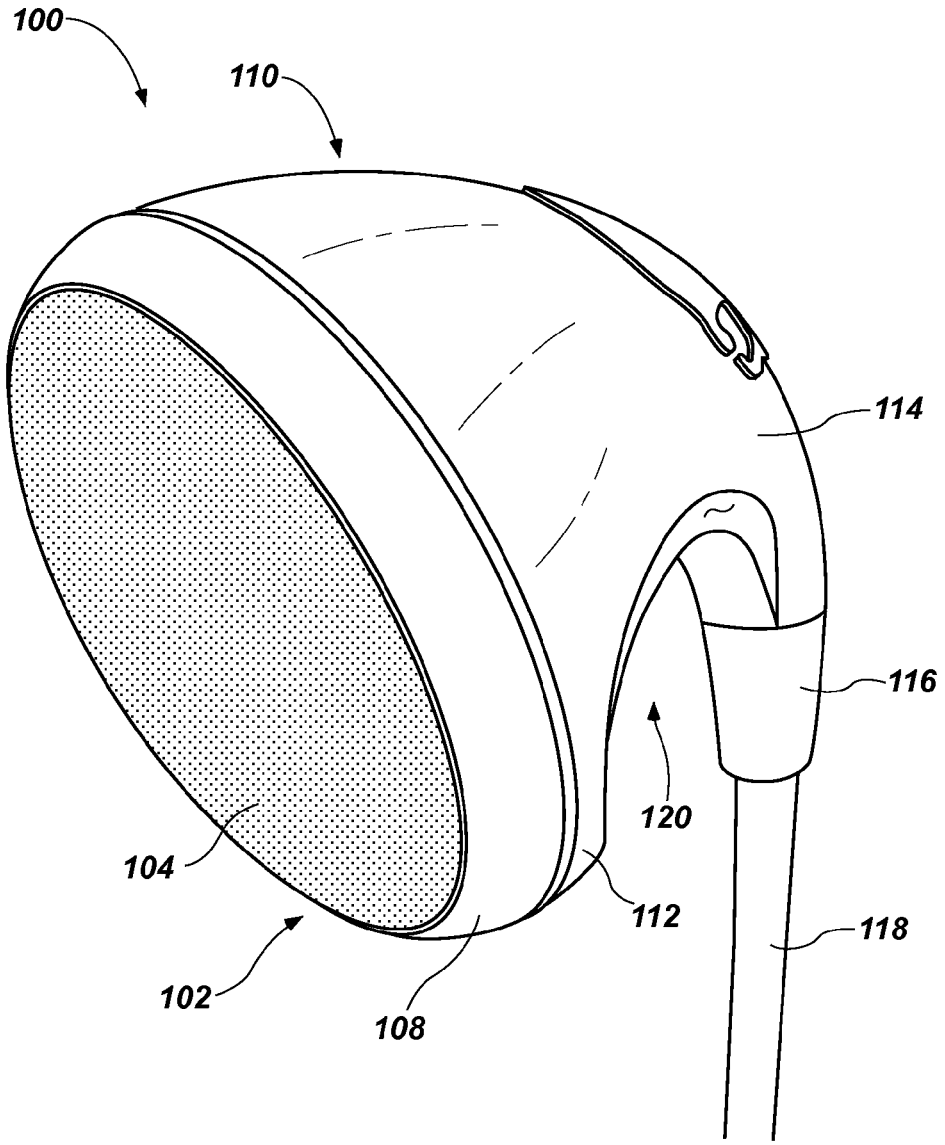
FIG. 3 illustrates a front, perspective view thereof.

In addition to the internal components, FIG. 1 shows that the speaker assembly 102 can also include various configurations of external components. For example, FIG. 1 shows that at least one implementation of the speaker assembly 102 includes a mesh speaker cover 104 (see FIG. 3). In one implementation, a manufacturer/designer can make the mesh speaker cover 104 from a variety of materials (e.g., aluminum or plastics). In alternative implementations, the mesh speaker cover 104 can have various configurations. For example, instead of having the mesh speaker cover 104, the speaker assembly 102 could include a speaker port or other configuration that allows the audible sound wave to leave the speaker assembly 102 and enter a user's ear.

Figure 2:
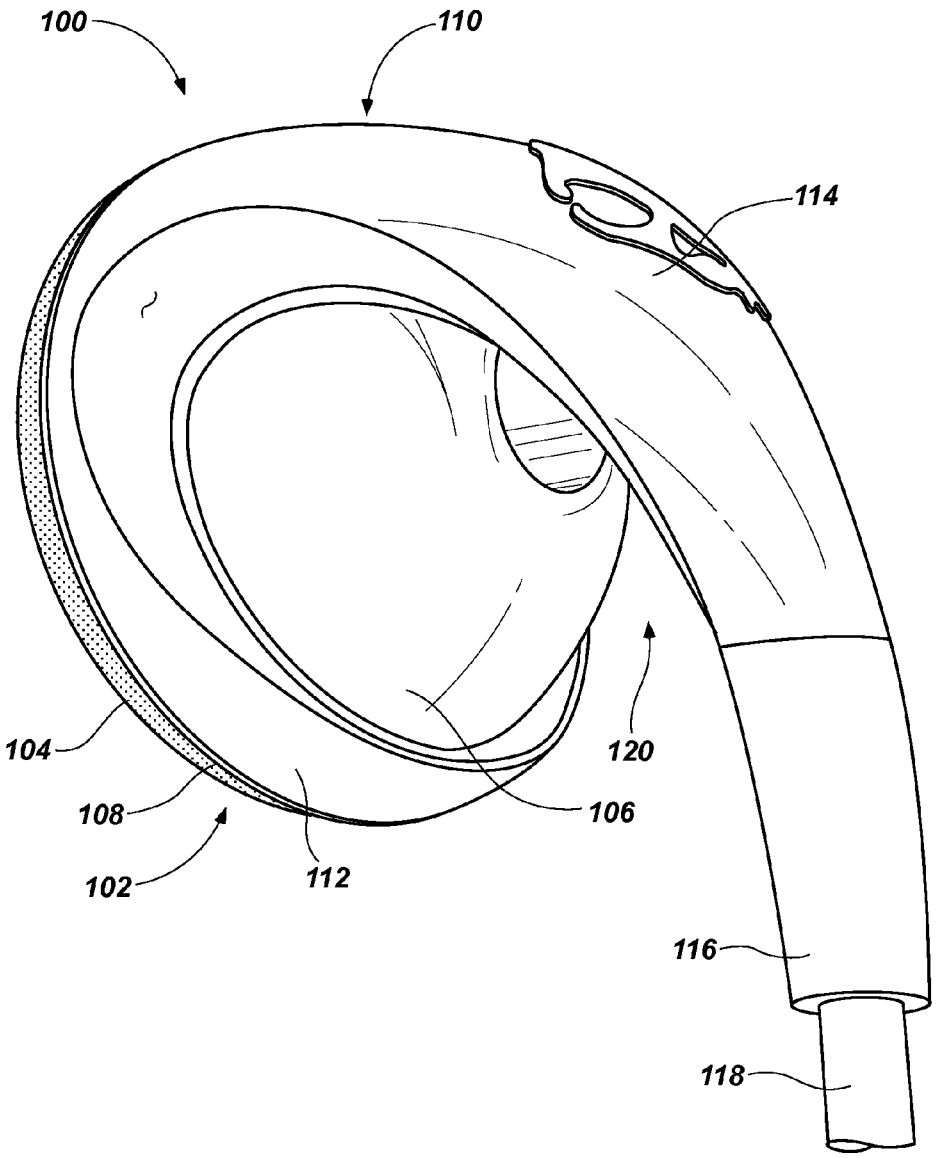
FIG. 2 illustrates a back, perspective view thereof.

In addition to the mesh speaker cover 104, FIG. 1 shows that the speaker assembly 102 can further include a speaker housing 106. In one implementation, the speaker housing 106 can cover the back portion of the speaker assembly 102 to help protect the internal components of the speaker assembly 102 (see also FIG. 2).

Figure 5:
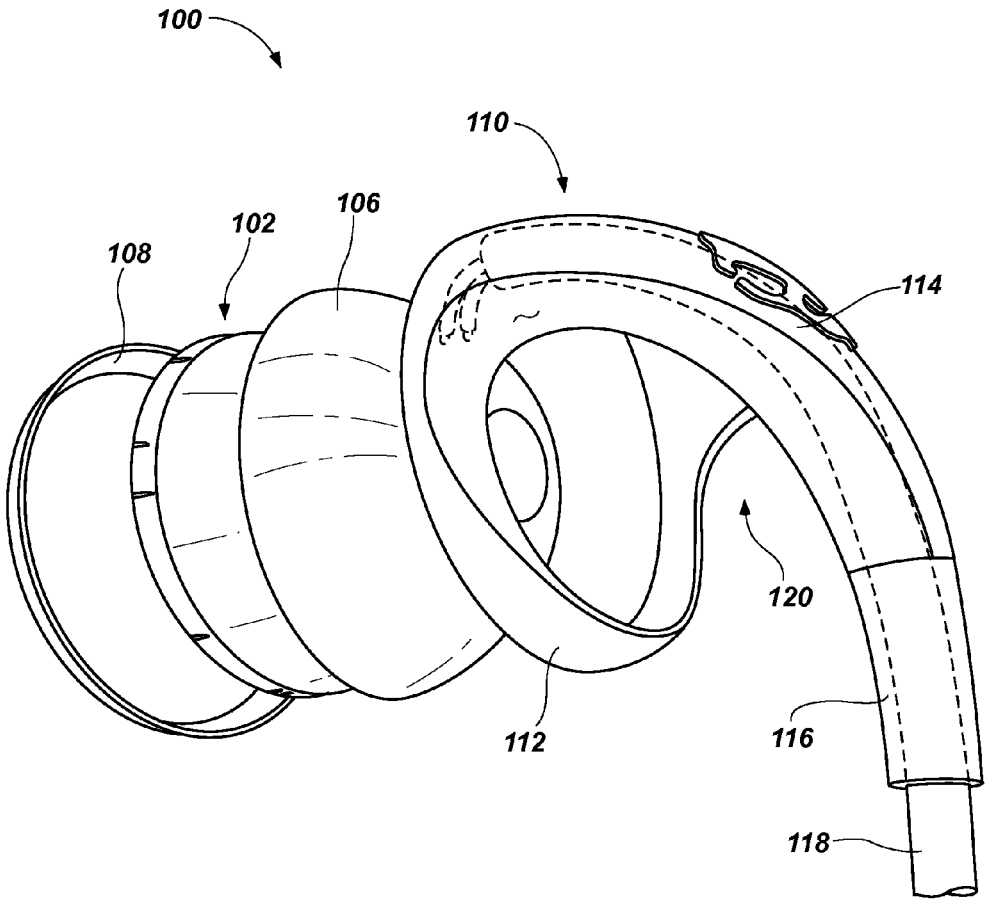
FIG. 5 illustrates an exploded view thereof.

Notably, in one example implementation, the speaker assembly 102, including the speaker cover 104 and speaker housing 106, is made from components separate from a main body portion 110 (see FIG. 5, for example). Due to the fact that the speaker assembly 102 is separate from the main body portion 110, the earbud headphone 100 can have an ergonomic configuration that is more comfortable to wear compared to traditional earbud headphones where the speaker assembly and the main body portion may be formed from a single integrated component.

As FIG. 1 illustrates, because the speaker assembly 102 and the main body portion 110 are separate components, a manufacturer can connect a wire 118 to the main body portion 110 at a wire interface 116, extend the wire 118 through the main body portion 110, and then connect the wire 118 to the speaker assembly 102 near the top of the main body portion 110 (see FIG. 5). Thus, the earbud headphone 100 can include a top entry wire 118 configuration, which in turn allows for an ergonomic gap 120 between the speaker housing 106 and the main body portion 110. Several other features and characteristics that relate to the top entry configuration will be discussed further below.

For example, a manufacturer/designer can configure the speaker housing 106 to have various acoustic properties to enhance the sound created by the speaker assembly 102. For example, the speaker housing 106 can include a port that extends through the speaker housing 106 (see FIG. 2 and FIG. 5). In alternative implementations, the speaker housing 106 may include more or fewer ports depending on how the manufacturer/designer desires to affect the acoustics of the speaker assembly 102. The speaker housing 106 can also include additional acoustic elements that a manufacturer/designer can use to control the acoustics of the speaker assembly 102.

Figure 4:
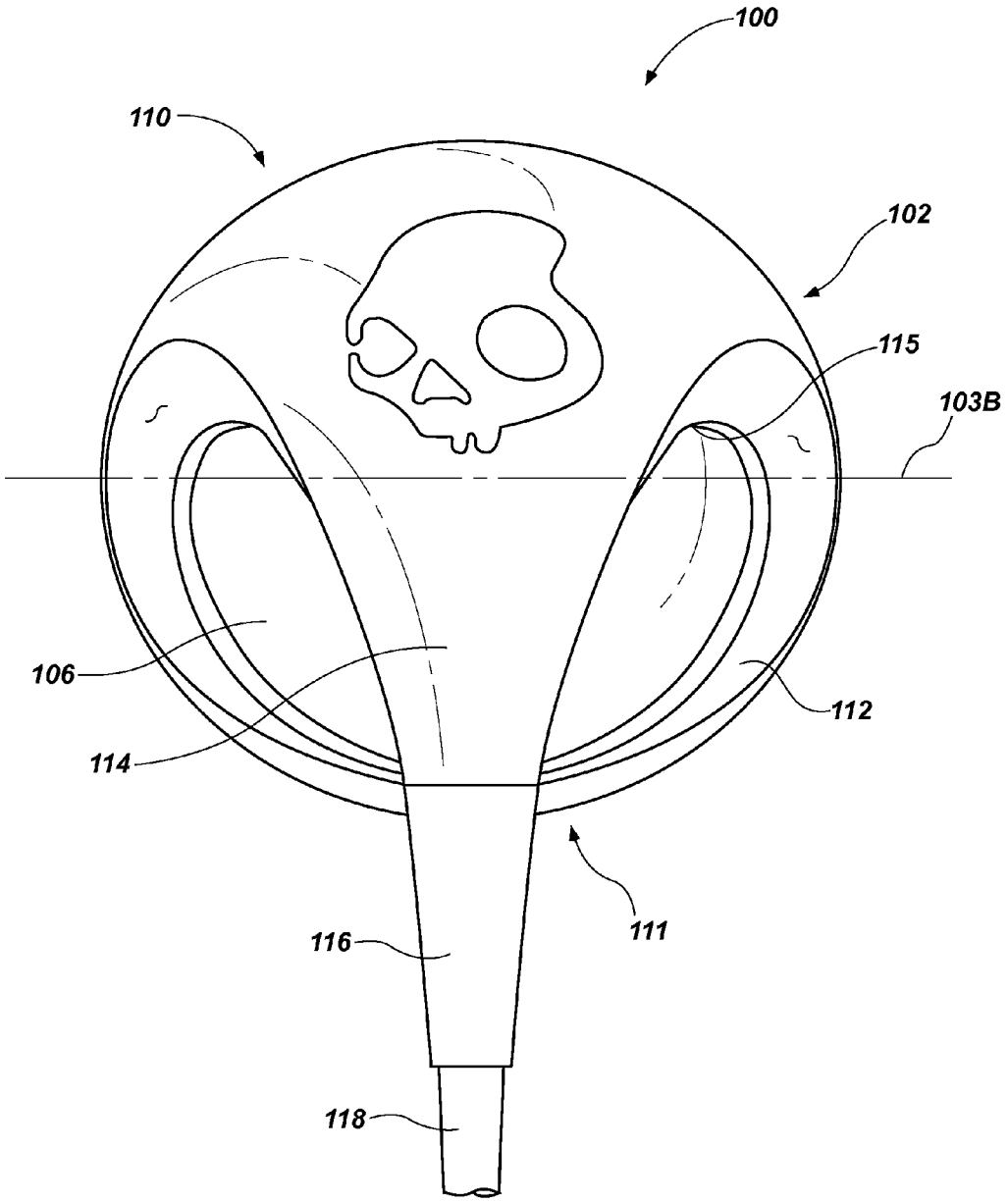
FIG. 4 illustrates a back view thereof.

In addition to various acoustical functions, one will appreciate that various other features of the speaker housing 106 can also assist to secure the earbud headphone 100 in a user's ear by interfacing or engaging with a portion of a user's ear. Specifically, a manufacturer/designer can configure the speaker housing 106, such that the speaker housing 106 comfortably interfaces with the user's ear. For example, FIG. 1 illustrates the speaker housing 106 having a substantially semi-spherical configuration with a flat end (see FIG. 2). The substantially semi-spherical configuration provides a smooth and comfortable interface surface for fitting within the outer portions of the user's ear canal. As shown in FIGS. 1 and 4, an extension 114 extends from the main body portion 110 at a location entirely vertically above a first horizontal central axis or centerline 103A (FIG. 1) of the speaker assembly 102, and a perpendicular and laterally oriented second horizontal axis or centerline 103B (FIG. 4) (perpendicular to the central axis or centerline 103A). The ergonomic gap 120 extends from a lower end 111 of the speaker assembly 102 to horizontally extending lower surfaces 115 of the extension 114 and the adjoining main body portion 110, which lower surfaces 115 are located vertically above the horizontal central axes or centerlines 103A, 103B of the speaker assembly 102.

Figure 7:
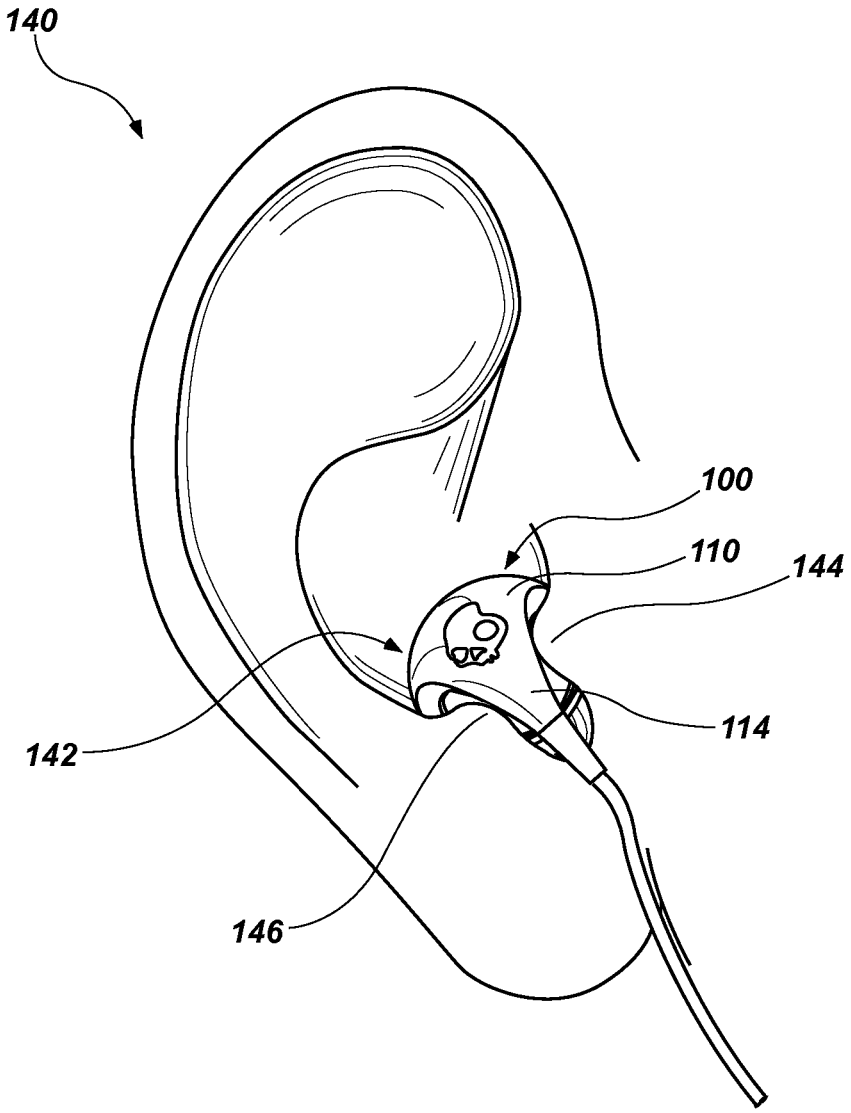
FIG. 7 illustrates the earbud headphone of FIGS. 1 through 5 in a human ear.

FIG. 7 is a drawing illustrating the earbud headphone 100 of FIGS. 1 through 5 in a user's ear 140. With combined reference to FIGS. 1, 4, and 7, when the earbud headphone 100 is inserted into the user's ear 140, the speaker assembly 102 may be inserted into a concha 142 of the user's ear 140, and positioned such that the extension 114 is disposed generally between a tragus 144 and an anti-tragus 146 of the user's ear 140. The speaker housing 106, the main body portion 110, a back retainer 112, and the extension 114 are sized and configured to allow the tragus 144 and the anti-tragus 146 of the user's ear 140 to extend into the ergonomic gap 120, including into portions thereof vertically above the horizontal axes or centerlines 103A, 103B of the speaker assembly 102. Thus, the speaker assembly 102 is able to rest deeper within the concha 142 of the user's ear 140 relative to previously known earbud headphones, and the tragus 144 and anti-tragus 146 are able to abut against surfaces of the earbud headphone 100 within the ergonomic gap 120, including lower surfaces 115 located vertically above the horizontal axes or centerlines 103A, 103B of the speaker assembly 102. Due to this configuration, the earbud headphone 100 may be securely retained in the ear 140 of a user wearing the earbud headphone 100.

Despite the configuration of the speaker housing 106, a manufacturer/designer can make the speaker housing 106 out of various materials. In one example implementation, the speaker housing 106 can be made from a soft elastic material, such as rubber. In other implementations, a manufacturer/designer can make the speaker housing 106 from foam, silicon, plastic, metal, composites, and/or any combination thereof.

Notwithstanding the various configurations, materials, and components of the speaker assembly 102, a manufacturer/designer can couple the speaker assembly 102 to the earbud headphone 100 in various manners with a number of functional ends in mind. For example, FIG. 1 shows that the earbud headphone 100 can include a front retainer 108 and the main body portion 110. The main body portion 110 can further include the back retainer 112. As shown in FIG. 1, a manufacturer/designer can configure the front retainer 108 and the back retainer 112 to couple together and secure the speaker assembly 102 in place between the front retainer 108 and the back retainer 112.

For example, in one implementation, the front retainer 108 and the back retainer 112 have a substantially ring-type configuration corresponding to the circumferential configuration of the speaker assembly 102 (see FIG. 5). One will appreciate that the manufacturer/designer can make the cross-sectional dimension of both the front retainer 108 and the back retainer 112 smaller than a cross-sectional dimension of the speaker assembly 102, such that a portion of the speaker assembly 102 cannot pass through either the front retainer 108 or the back retainer 112. Thus, and as FIG. 1 illustrates, a manufacturer/designer can configure the front retainer 108 and the back retainer 112 to securely hold the speaker assembly 102 in place when the front retainer 108 and the back retainer 112 are coupled together.

The front retainer 108 and the back retainer 112 can couple together in various manners. For example, in one implementation, the front retainer 108 and the back retainer 112 can include a snap-fit connection. In particular, the front retainer 108 can include one or more tabs (not shown) that engage one or more corresponding slots (not shown) located on the back retainer 112. In alternative implementations, the front retainer 108 can couple to the back retainer 112 using threads, a slip-fit connection, adhesives, and/or other fasteners. In at least one implementation, a manufacturer/designer can configure the front retainer 108 and the back retainer 112 to be coupled and decoupled by the user in order to exchange components of the earbud headphone 100, such as the speaker assembly 102, as will be explained in more detail below.

In addition to including the back retainer 112, FIG. 1 shows that to secure the speaker assembly 102, the main body portion 110 can also include features to guide electrical connections. For example, FIG. 1 illustrates the main body portion 110 with the extension 114 that extends away from the speaker assembly 102. FIG. 1 shows, for example, that the extension 114 can connect to the wire interface 116, which couples the wire 118 to the extension 114 (see FIG. 4). A manufacturer/designer can then use the extension 114 to guide the wire 118 through the extension 114 to connect with the speaker assembly 102. In alternative implementations, a manufacturer/designer can make the earbud headphone 100 a wireless headphone and, therefore, the wireless earbud headphone 100 may not include the wire interface 116 or the wire 118.

Not only can the extension 114 guide the wire 118 to the speaker assembly 102, but the extension 114 can also assist in securing the earbud headphone 100 within a user's ear 140 (FIG. 7). For example, FIG. 1 illustrates that the extension 114 can extend away from the speaker assembly 102, such that the extension 114 creates the gap 120 between the extension 114 and the speaker housing 106 (see also FIG. 2 and FIG. 3). Thus, when a user is wearing the earbud headphone 100, the speaker assembly 102, including the speaker housing 106, can go inside the user's outer ear 140. The extension 114 extends away from the user's ear 140 and thereby allows the user to secure at least a portion of the user's ear 140 in the gap 120 between the speaker housing 106 and the extension 114. Thus, the earbud headphone 100 actively engages at least a portion of the user's ear 140.

To further secure the earbud headphone 100 within the user's ear 140, a manufacturer/designer can form the extension 114 from various materials. In one example implementation, the extension 114 material can be a bendable material that substantially holds a position after the user bends the extension 114 to conform the shape of the extension 114 to the user's ear 140. For example, a manufacturer/designer can make the extension 114 out of a bendable inelastic material, such as a metal rod (e.g., aluminum or copper), or one or more memory metals. In one implementation, the extension 114 can take the form of a metal rod covered in rubber or bendable plastic, such that the extension 114 is not only bendable, but also comfortable on the user's ear. The bendable extension 114 provides for an adjustable gap 120 width that allows a user to secure at least a portion of the user's ear securely in the gap 120, regardless of the size or shape of the user's ear.

In further implementations, a manufacturer/designer can make the extension 114 from non-bendable materials, such as hard plastics or composites. When the extension 114 is made from non-bendable materials, a manufacturer can choose to make the speaker housing 106 out of an elastic material, as discussed above. Therefore, because the speaker housing 106 is elastic, the speaker housing 106 can deflect slightly as a user positions a portion of the user's ear within the gap 120. Once the user has positioned the earbud headphone 100 in a comfortable position, the speaker housing 106 expands to gently clamp a portion of the user's ear between the speaker housing 106 and the extension 114, thus providing a secure and comfortable fit.

As can be appreciated, the extension 114 illustrated in FIGS. 1 through 5 is only one implementation of the extension 114, and the extension 114 configuration can vary from one implementation to the next. For example, FIG. 1 through FIG. 5 illustrate various views of the earbud headphone 100 that show the extension 114 as having a sweeping curved configuration extending away from the speaker assembly 102 (see FIG. 2 and FIG. 5). In alternative implementations, the extension 114 configuration can take almost any form. For example, a manufacturer/designer can configure the extension 114 with a substantially square configuration (not shown). In such a configuration, the extension 114 can extend substantially perpendicular from the speaker assembly 102 and then make about a ninety degree angle downward to create the gap 120 between the extension 114 and the speaker assembly 102.

Notwithstanding the configuration of the extension 114, a manufacturer/designer can configure the earbud headphone 100 with interchangeable components, such that a user can customize the size, look, and fit of the earbud headphone 100. For example, FIG. 5 illustrates one implementation of the earbud headphones 100 with various interchangeable components. In particular, FIG. 5 illustrates an exploded view of an example earbud headphone 100 that can include interchangeable components that a user can exchange to customize the earbud headphone 100.

For example, the interchangeable components can include the speaker assembly 102, the speaker cover 104, the speaker housing 106, and even the main body portion 110. Thus, for example, if the user desires to change the acoustic properties of the earbud headphone 100, the user can exchange the speaker assembly 102 and/or the speaker housing 106 to create a customized sound. Similarly, if the user desires to change the fit of the earbud headphone 100, then the user can exchange the speaker housing 106 and/or the main body portion 110 with different sizes or configurations. Of course, a user can change the look and style of the earbud headphones 100 by exchanging any component of the earbud headphone 100.

In one implementation, a manufacturer/designer can produce kits that include various interchangeable components. In particular, a manufacturer/designer can provide a kit that includes one or more components that replace, or couple to, the front retainer 108 to change the size or geometric configuration of the portion of the earbud headphone 100 that is adjacent to the ear canal (or in some cases partially extending into the ear canal). For example, the kit can provide components that increase/decrease the diameter of the front retainer 108, and/or provide various configurations of cushions, extensions, or similar features to the earbud headphone 100, such that a user can customize the way in which the earbud headphone 100 interfaces with the user's ear.

Figure 6A:
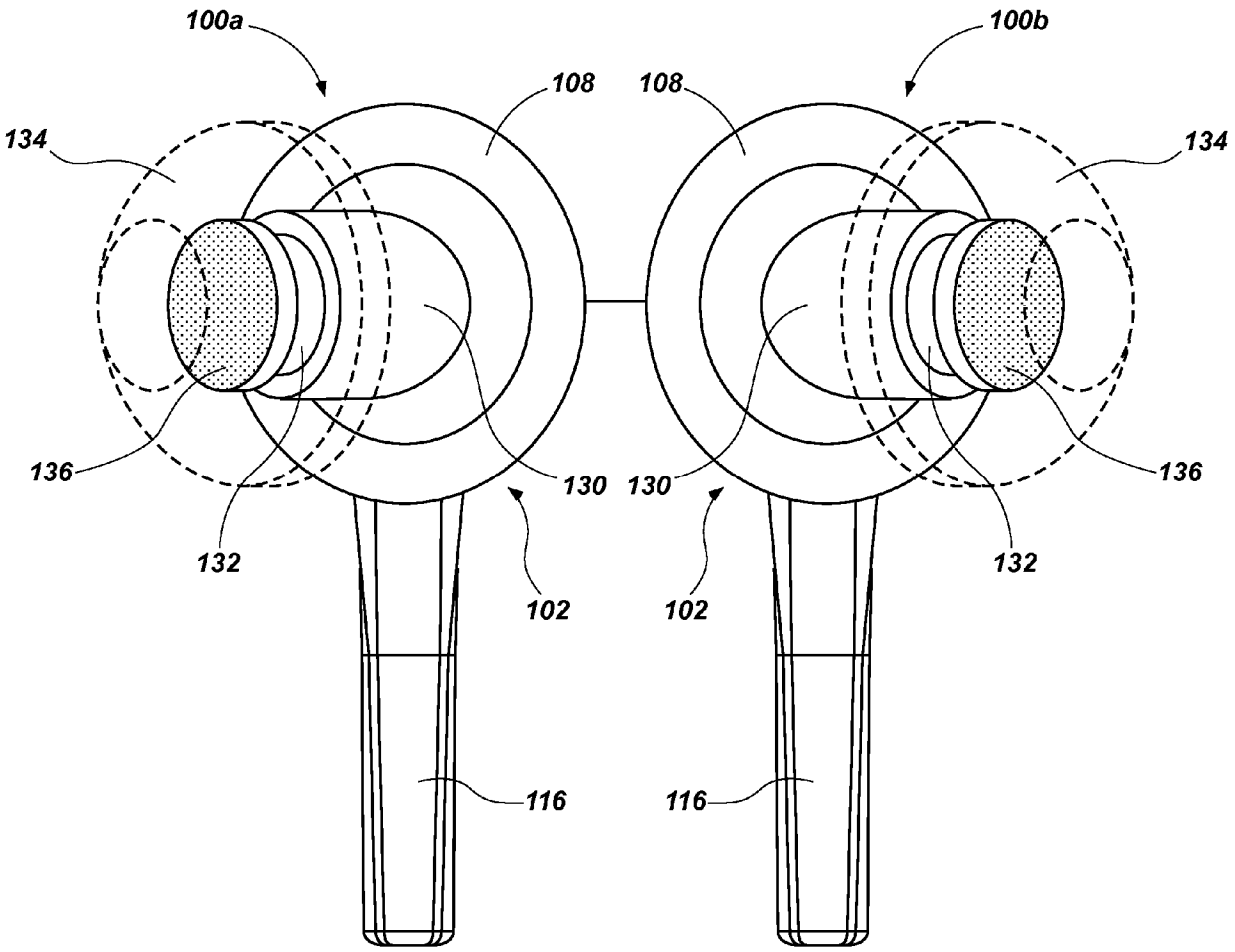
FIGS. 6A and 6B illustrate an example implementation of an earbud headphone with an in-ear protrusion.
Figure 6B:
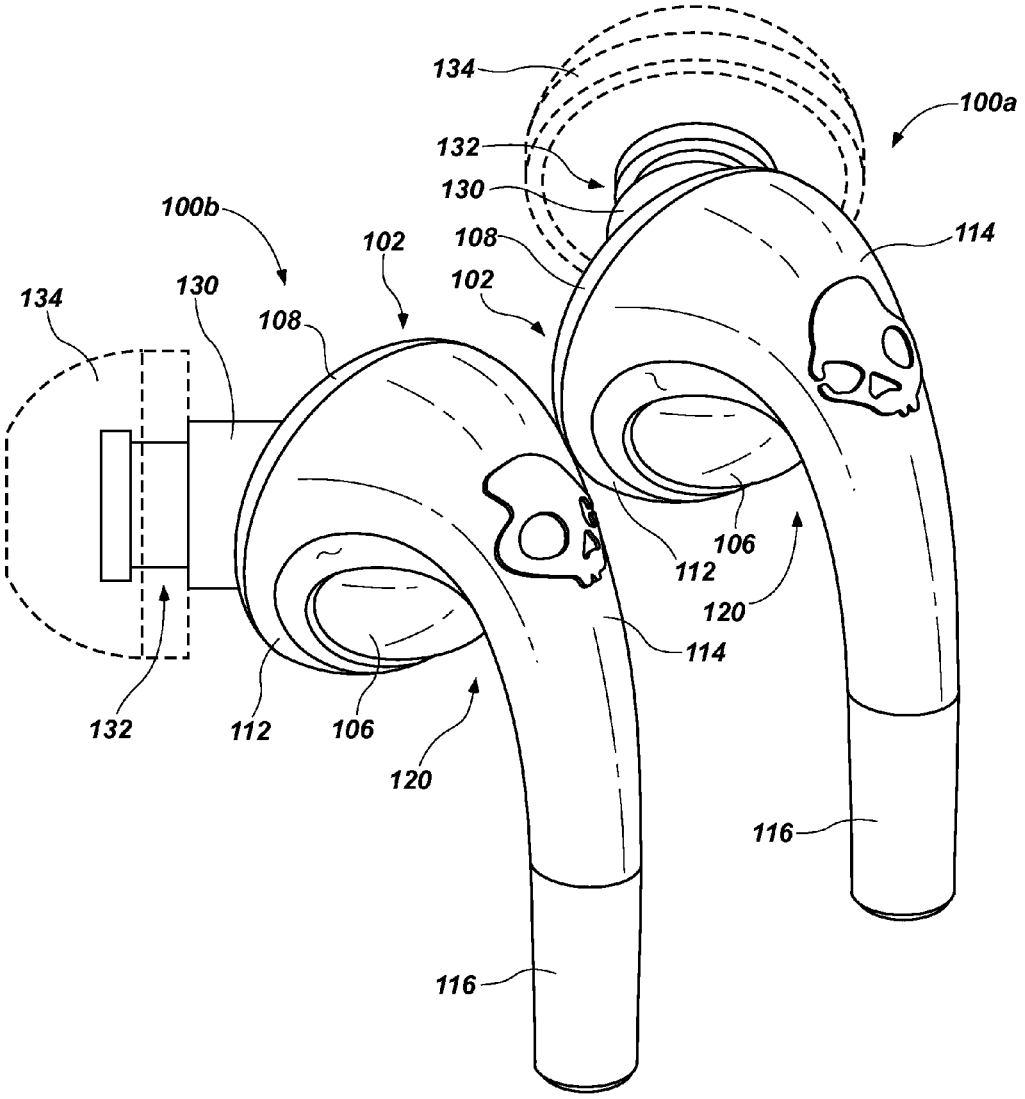

As explained above, a manufacturer/designer can make the front retainer 108 be removably coupled to the back retainer 112 allowing a user to separate the front retainer 108 from the back retainer 112 to exchange one or more components. For example, FIGS. 6A and 6B illustrate one example implementation that is possible for a user to create upon removing the front retainer 108 from the back retainer 112 and exchanging components. In particular, FIGS. 6A and 6B illustrate a right earbud headphone 100*a* and a left earbud headphone 100*b* that include an in-ear protrusion 130 that can replace the speaker cover 104 illustrated in FIGS. 1 through 3. As shown in FIGS. 6A and 6B, each of the in-ear protrusions 130 extends in a lateral direction from the respective speaker assembly 102 that is oriented at an acute angle relative to the first horizontal central axis or centerline 103A (see FIG. 1) of each speaker assembly 102.

As FIGS. 6A and 6B show, a user can secure the in-ear protrusion 130 between the front retainer 108 and the back retainer 112. In addition, a user can customize the direction in which the in-ear protrusion extends by rotating the in-ear protrusion 130 with respect to the front retainer 108 and back retainer 112, thus creating a customized look and fit for an individual user. For example, FIGS. 6A and 6B illustrate that the in-ear protrusion 130 in the right earbud headphone 100*a* is positioned in a substantially mirrored position with respect to the in-ear protrusion 130 in the left earbud headphone 100*b*. This can accommodate the generally mirrored characteristics between a user's right and left ears.

To further accommodate a particular user's ear, various features and characteristics of the in-ear protrusion 130 can vary. For example the length, shape, and cross-sectional dimension(s) of the in-ear protrusion 130 can vary from one implementation to the next, allowing a user to change from one in-ear protrusion 130 configuration to another. In particular, a user can use one configuration of the in-ear protrusion 130 in the right earbud headphone 100*a* and a different in-ear protrusion 130 configuration in the left earbud headphone 100*b*. This difference can accommodate even subtle differences between a user's right ear and left ear.

In order to further customize the in-ear protrusion 130, FIGS. 6A and 6B illustrate that the in-ear protrusion 130 can include an indent 132 that allows a user to mount a protrusion cover 134 to the end of the in-ear protrusion 130. In one implementation, the protrusion cover 134 is a soft and formable rubber-like material that can conform to the shape of a user's inner ear. As with the configuration of the in-ear protrusion 130, the size and shape of the protrusion cover 134 can vary from one implementation to the next to allow a user to specifically customize the fit of the earbud headphone 100 within the user's ear.

In addition to the protrusion cover 134, the in-ear protrusion 130 can include various other features and characteristics. For example, FIGS. 6A and 6B illustrate that the in-ear protrusion 130 can include a protrusion mesh 136 that protects the speaker assembly 102 from dust and other contaminants. In an alternative implementation, the in-ear protrusion 130 does not include the protrusion mesh 136.

Regardless of the various characteristics of the in-ear protrusion 130, FIGS. 6A and 6B illustrate that the earbud headphones 100 (i.e., 100*a* and 100*b*) can utilize both the in-ear protrusion 130 and the gap 120 to secure the earbud headphones 100 in the ear of a user. For example, the in-ear protrusion 130 secures the earbud headphone 100 within the inner portion of a user's ear, while the gap 120 interfaces with an outer portion of a user's ear. In this manner, the earbud headphone 100 comprises multiple bases for a fit that is both comfortable and secure compared to conventional headphones.

Of course, one will appreciate that FIGS. 1 through 6B illustrate only some example implementations of the interchangeable earbud headphone 100. In particular, one will appreciate that other implementations can have more, fewer, or different components depending on the particular implementation of the earbud headphone 100. Example implementations of the present invention can, therefore, include earbud headphones that provide a comfortable and secure fit within a user's ear. Thus, implementations of the present invention allow a user to enjoy the portability and size of the earbud headphone, while enjoying a comfortable fit that does not easily fall out of the user's ear. Moreover, implementations of the present invention provide for a customizable earbud headphone in which a user can customize one or more components of the earbud headphone to tailor the fit, look and/or acoustics of the earbud headphone 100.

The present invention thus can be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An earbud headphone, comprising:

a speaker assembly capable of converting an audio signal into a sound wave audible to the human ear;

a main body portion at least partially enclosing the speaker assembly; and an extension extending from the main body portion away from the speaker assembly and defining a gap between the extension and the speaker assembly;

wherein the speaker assembly is sized and configured to rest in the concha of an ear of a person using the earbud headphone, and wherein the main body portion and the speaker assembly are sized and configured such that the tragus and anti-tragus of the ear of a person using the earbud headphone extend into the gap formed between the extension and the speaker assembly; and wherein a geometric center of a cross-sectional area of the extension taken in a plane extending at least substantially perpendicular to a central horizontal axis of the speaker assembly at an intersection between the speaker assembly and the extension is located vertically above the central horizontal axis.

2. The earbud headphone of claim 1, wherein the main body portion and the speaker assembly are sized and configured such that the tragus and anti-tragus of the ear of a person using the earbud headphone extend into a portion of the gap located vertically above the central horizontal axis of the speaker assembly.

3. The earbud headphone of claim 1, wherein the gap between the extension and the speaker assembly extends from a bottom, lower end of the speaker assembly to a location vertically above the central horizontal axis of the speaker assembly.

4. The earbud headphone of claim 3, wherein horizontally extending lower surfaces of the extension are located vertically above the central horizontal axis of the speaker assembly.

5. The earbud headphone of claim 1, further comprising an in-ear protrusion that extends from the speaker assembly in a lateral horizontal direction oriented at an acute angle relative to the central horizontal axis of the speaker assembly.

6. The earbud headphone of claim 5, wherein the in-ear protrusion is rotatable with respect to the main body portion to allow the person using the earbud headphone to adjust the angle at which the in-ear protrusion extends into the ear of the person using the earbud headphone.

7. The earbud headphone of claim 1, wherein the speaker assembly further comprises a speaker housing that extends into the gap between the extension and the speaker assembly.

8. The earbud headphone of claim 7, wherein the speaker housing is made from an elastic material.

9. The earbud headphone of claim 1, wherein the extension is made from a bendable material, such that the person using the earbud headphone can adjust the width of the gap between the extension and the speaker assembly.

10. The earbud headphone of claim 1, further comprising:

a front retainer; and a back retainer that is formed on the main body portion, wherein the speaker assembly is secured between the front retainer and the back retainer.

11. A personal audio speaker system for use with a portable media playing device, comprising a set of two earbud headphones, each of the two earbud headphones comprising:

a speaker assembly;

a main body portion that at least partially encloses the speaker assembly; and an extension extending from the main body portion such that a gap is formed between the extension, the main body portion, and the speaker assembly, the gap extending from a bottom, lower end of the speaker assembly to a location vertically above a central horizontal axis of the speaker assembly;

wherein a geometric center of a cross-sectional area of the extension taken in a plane extending at least substantially perpendicular to the central horizontal axis of the speaker assembly at an intersection between the speaker assembly and the extension is located vertically above the central horizontal axis.

12. The personal audio speaker system of claim 11, wherein each of the two earbud headphones further comprises a speaker housing at least partially enclosing the speaker assembly.

13. The personal audio speaker system of claim 12, wherein the speaker housing comprises an elastic material.

14. The personal audio speaker system of claim 12, further comprising a front retainer that cooperates with the main body portion to hold the speaker assembly and the speaker housing in place within the main body portion.

15. The personal audio speaker system of claim 14, wherein the front retainer is removably coupled to the main body portion such that a user can remove the front retainer and exchange at least one of the following components to customize the personal audio speaker system:

the speaker assembly;

the speaker housing; and the main body portion.

16. The personal audio speaker system of claim 11, wherein the extension comprises a bendable material that a user can displace to adjust a dimension of the gap.

17. The personal audio speaker system of claim 11, wherein the speaker assembly is sized and configured to rest in the concha of an ear of a person using the earbud headphone, and wherein the main body portion and the speaker assembly are sized and configured such that the tragus and anti-tragus of the ear of a person using the earbud headphone extend into the gap formed between the extension, the main body portion, and the speaker assembly.

18. The personal audio speaker system of claim 11, wherein the main body portion and the speaker assembly are sized and configured such that the tragus and anti-tragus of an ear of a person using the earbud headphone extend into portions of the gap located vertically above the central horizontal axis of the speaker assembly.

19. The personal audio speaker system of claim 11, wherein horizontally extending lower surfaces of the extension are located vertically above the central horizontal axis of the speaker assembly.

20. The personal audio speaker system of claim 11, wherein each of the two earbud headphones further comprises an in-ear protrusion that extends from the speaker assembly in a lateral horizontal direction oriented at an acute angle relative to the central horizontal axis of the speaker assembly.

* * * * *